United States Patent [19]

Kraatz

[11] 4,002,129

[45] Jan. 11, 1977

[54] CLAMPING APPARATUS FOR AUTOMATIC SEWING MACHINE

[75] Inventor: Gerald A. Kraatz, Highland Park, Ill.

[73] Assignee: Union Special Corporation, Chicago, Ill.

[22] Filed: July 3, 1975

[21] Appl. No.: 592,833

[52] U.S. Cl. ..... 112/121.15

[51] Int. Cl.[2] ..... D05C 9/04

[58] Field of Search ..... 112/121.15, 121.12, 112/104, 153, 114

[56] References Cited

UNITED STATES PATENTS

| | | | |
|---|---|---|---|
| 3,513,791 | 5/1970 | Fulp | 112/121.15 X |
| 3,742,879 | 7/1973 | Schaefer, Jr. | 112/121.12 |
| 3,776,154 | 12/1973 | Weiss | 112/114 |
| 3,794,230 | 2/1974 | Bryan et al. | 112/153 X |

*Primary Examiner*—Werner H. Schroeder
*Assistant Examiner*—Peter Nerbun

[57] ABSTRACT

Clamping apparatus for an automatic sewing machine comprising, first clamp means for retaining a first work piece, and second clamp means for retaining a second work piece adjacent the first work piece. Means is provided for movably mounting the first and second clamp means for relative movement therebetween with the first clamp means being located intermediate the second clamp means and a work surface. First means is provided for applying a separating force between the first and second clamp means. Second means is also provided for selectively applying a variable force against the second clamp means in a direction urging the second clamp means toward the first clamp means, with the second applying means separately applying forces at levels less than and greater than the separating force.

30 Claims, 12 Drawing Figures

CLAMPING APPARATUS FOR AUTOMATIC SEWING MACHINE

BACKGROUND OF THE INVENTION

During certain operations on a sewing machine it is desirable to sew first and second work pieces together. For example, it may be desirable to sew or tack corners of a label to a fabric. The sewing machine should be capable of performing this operation in a simple and efficient manner in order to enhance high-speed production in the garment industry. Additionally, the machine should provide for accurate positioning of the label relative to the fabric, while not detracting from efficiency of the sewing operation.

SUMMARY OF THE INVENTION

A principal feature of the present invention is the provision of clamping apparatus for an automatic sewing machine for retaining first and second work pieces in a simplified and efficient manner.

The clamping apparatus of the present invention comprises, first clamp means being movable toward and away from a work surface on the machine for retaining the first work piece. The apparatus has second clamp means for retaining the second work piece adjacent the first work piece. Means is provided for movably mounting the first and second clamp means for relative movement therebetween with the first clamp means being located intermediate the second clamp means and the work surface. The apparatus has first means for effectively applying a separating force between the first and second clamp means. Second means is also provided for selectively applying a variable force effectively against the second clamp means in a direction urging the second clamp means toward the first clamp means. The second applying means separately applies a force of a first level less than the separating force during a first mode of operation, and a force of a second level greater than the separating force during a second mode of operation.

A feature of the invention is that the first work piece may be positioned below the first clamp means before the second applying means is selected to apply a force against the second clamp means.

Another feature of the invention is that the second applying means may be selected to apply the first force level after placement of the first work piece.

Yet another feature of the invention is that the first clamp means engages against the first work piece and the second clamp means remains spaced from the first clamp means during the first mode of operation.

A feature of the invention is that the second work piece may be placed in opening means defined by the first clamp means after the first clamp means is engaged against the first work piece during the first mode of operation.

A further feature of the invention is that the size of the opening means may be selected approximately equal to the size of the second work piece to facilitate alignment of the second work piece relative the first work piece.

Yet another feature of the invention is that the second applying means may be selected to apply the second force level against the second clamp means.

Still another feature of the invention is that the first and second clamp means moves toward each other during the second mode of operation.

A feature of the invention is that the second clamp means may include flange means receivable in the opening means of the first clamp means to engage against the second work piece during the second mode of operation.

Another feature of the invention is that the interengaged first and second clamp means retain the second work piece in position against the first work piece during a subsequent sewing operation.

Thus, a feature of the present invention is that the first and second work pieces may be positioned for the sewing operation in an efficient manner.

Another feature of the invention is that the second work piece is accurately aligned relative the first work piece for performing the sewing operation.

Still another feature of the invention is the provision of third clamp means positioned adjacent the work surface on which the first work piece may be placed prior to lowering the first clamp means during the first mode of operation.

Yet another feature of the invention is that the clamping apparatus is relatively compact and lightweight.

Further features will become more fully apparent in the following description of the embodiments of this invention and from the appended claims.

DESCRIPTION OF THE PREFERRED EMBODIMENTS

Figure 1:
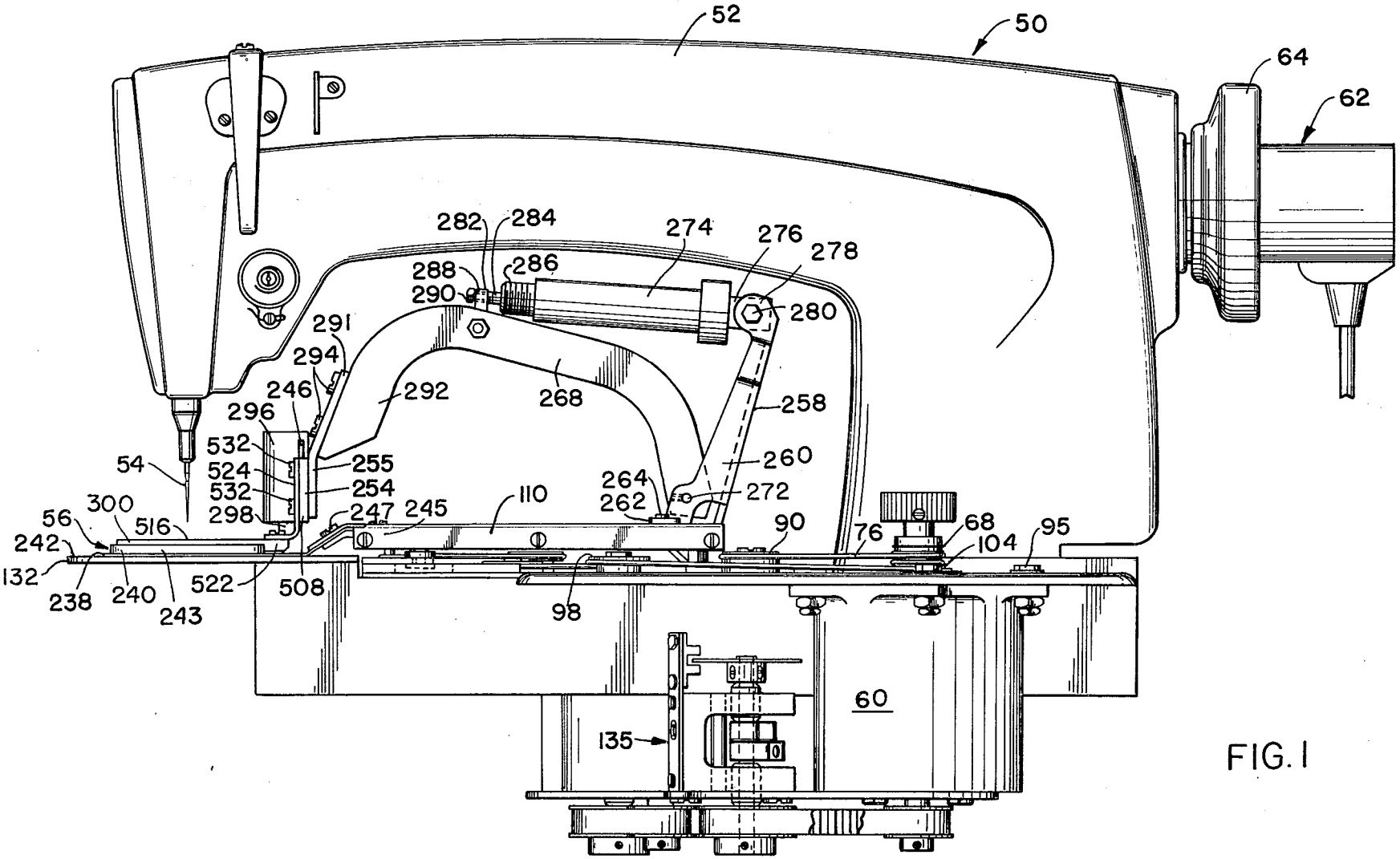
FIG. 1 is a side elevation view of an automatic sewing machine having clamping apparatus of the present invention.
Figure 2:
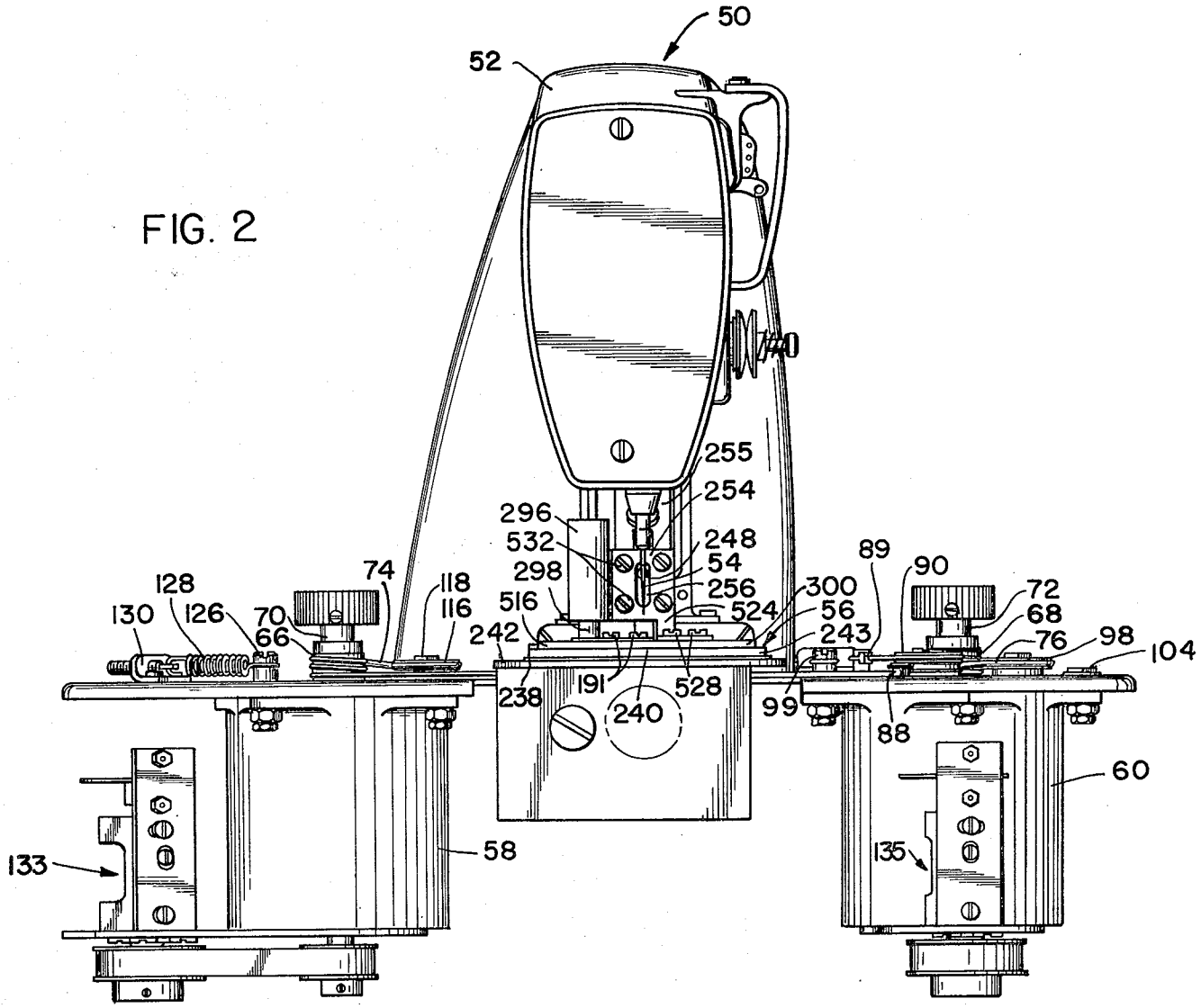
FIG. 2 is a front plan view of the sewing machine and apparatus of FIG. 1.
Figure 3:
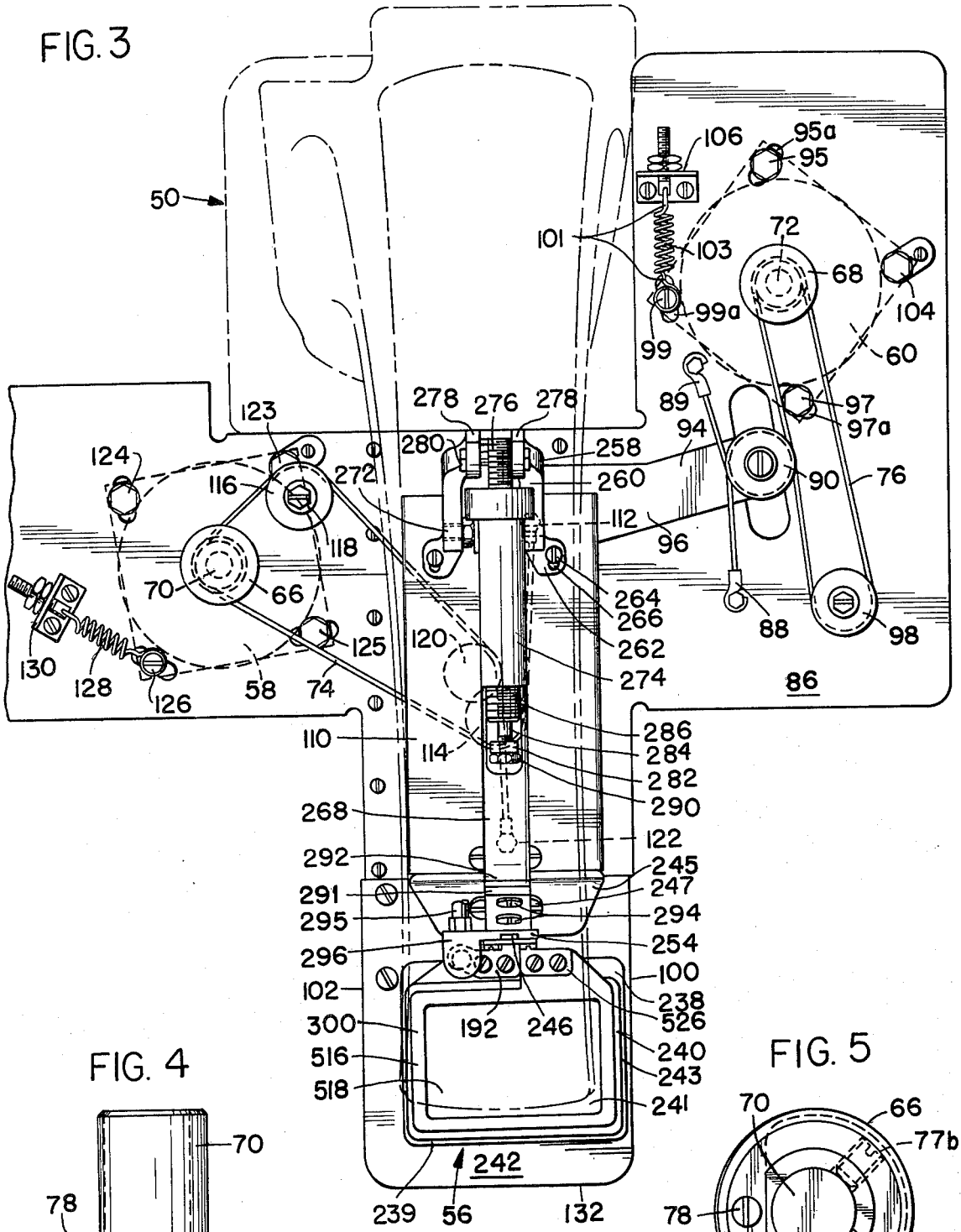
FIG. 3 is a top plan view of the sewing machine and apparatus of FIG. 1.

Referring now to FIGS. 1–3, there is shown a sewing machine 50 according to the invention having an overhanging arm 52 which carries mechanical power to a sewing needle 54. The work piece to be sewn (not shown) is retained by a work holder generally designated 56 which is moved in a horizontal plane by a power translation system. This system is driven by a pair of stepping motors 58 and 60 positioned on opposite sides of the arm 52 which supply driving power to move the work holder in two coordinate directions, termed the X and Y coordinate or reference directions. The power translation system acts to translate the rotary drive of the stepping motors to movement of the work holder in its two coordinate directions, with the Y coordinate direction being generally aligned with the longitudinal axis of the arm 52, and with the X coordinate direction being transverse to the longitudinal axis of the arm.

The stepping motors are driven by electrical signals from electrical circuitry of a control system. These signals are synchronized to the movement of the needle 54 into and out of the work piece by an electromechanical synchronization unit 62. The unit 62 is connected to and driven by a hand wheel 64 of the sewing machine, and supplies synchronization signals to the electrical circuitry. The control system and circuitry is described in co-pending application Ser. Nos. 496,748 and 592,951, incorporated herein by reference.

The work holder is moved in a predetermined pattern relative to the movement and position of the sewing machine needle. As described in said co-pending applications, a sequence of instructions describing the desired pattern of movement and stitching of the work holder 56 is stored in a storage element or memory unit having a plurality of randomly addressable storage locations. The instructions may include information utilized as commands for controlling movement of the work holder and reciprocation of the needle, and positional information for directing movement of the work holder relative the needle in variable distances along the two coordinate directions.

The electrical control circuitry reads information from as many of the addressable locations of the storage element as necessary to obtain a complete instruction for each movement of the work holder. It also converts each instruction into a sequence of pulses to be applied to the stepping motors, and thus drives the motors at a time when, as indicated by the synchronizing unit 62, the needle 54 is not engaged in the work piece. In this manner, movement of the work holder is timed not to adversely affect the movement of the sewing needle 54.

As best shown in FIG. 3, the power translating system used to transmit power from stepping motors 58 and 60 to the work holder 56 comprises two cable systems, or other suitable means, such as gears, with one being provided for each coordinate direction. The cable systems are arranged as follows. Pulleys 66 and 68 are attached to the shafts 70 and 72 of the stepping motors 58 and 60, respectively. Cables 74 and 76 are secured around the pulleys 66 and 68, respectively, as will be described below. In this manner, the rotational movement of the stepping motor shafts 70 and 72 is converted into linear movement of the cables 74 and 76.

Figure 4:
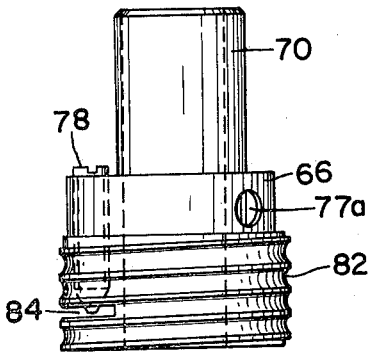
FIG. 4 is an elevational view of a pulley for drive means in the sewing machine of FIG. 1.
Figure 5:
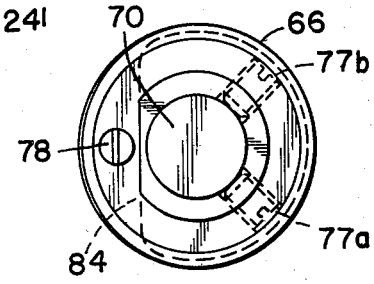
FIG. 5 is a top plan view of the pulley of FIG. 4.

Since both pulleys 66 and 68 and associated structure may be substantially the same, the pulley 66 will be described as representative in connection with FIGS. 4 an 5. As shown, the pulley 66 may be secured to the associated motor shaft 70 by a pair of screws 77*a* and 7*b*. The associated cable may be wound a plurality of times, e.g., 2¼ to 2½ rounds, in a spiral groove 82 formed in the outer surface of the pulley, with a central portion of the wound cable being received in a circumferential cutout 84, where the cable may be secured to the pulley by a screw 78. Thus, at least part of a turn of the cable is made above the cutout 84 and part of a turn of the cable is made below the cutout. In this manner, the appropriate cable is rigidly secured to each pulley.

Figure 7:
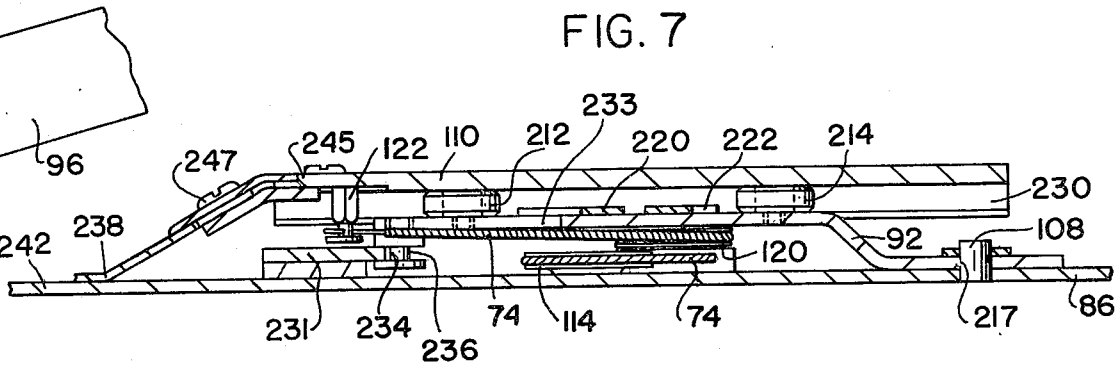
FIG. 7 is a sectional view taken substantially as indicated along the line 7—7 of FIG. 6.
Figure 6:
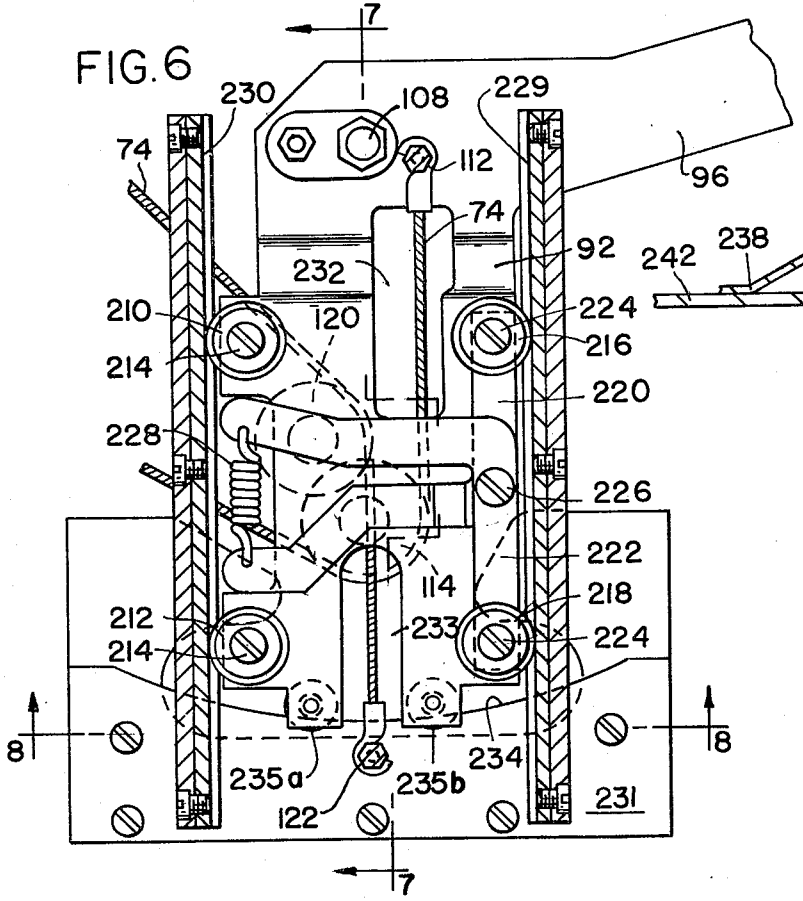
FIG. 6 is a sectional view of extendable arm means for the sewing machine of FIG. 1.

Referring now to FIGS. 1–3, 6, and 7 the cable 76, which pivots the work holder about a pivot pin 108 secured to a base plate 86 of the sewing machine, is attached at both ends to the base plate 86 by a pair of hook and shoulder screws 88 and 89. As best shown in FIG. 3, portions of the cable 76 are threaded in opposite rotational directions in upper and lower grooves of two free turning pulleys 90. As illustrated in FIGS. 3, 6, and 7, the pulley 90 is rotably mounted adjacent an end 94 of a connecting member 96 extending from a pivoting arm 92 which is pivotally mounted on the base plate 86 by the pivot pin 108. Referring again to FIG. 3, one turn of the cable 76 passes from the pulley 90 to the motor pulley 68, while the other turn of the cable passes from the pulley 90 to a free turning pulley 98 which is pivotally mounted on the base plate 86. As shown, the cable 76 is threaded around the pulley 98 from where it passes to the motor pulley 68, such that the cable 76 is threaded around the pulleys 90, 98 and 68 intermediate its ends.

Since the cable ends are fixed, it will be apparent that as the stepping motor 60 rotates the motor pulley 68, the cable course between pulleys 90 and 68 will be shortened or enlarged, depending upon the rotational direction of the motor shaft 72, while the cable course between the pulleys 90 and 98 will be simultaneously enlarged or shortened in an inverse manner. Accordingly, if the motor pulley 68 is driven by the motor 60 in a clockwise direction, as viewed in FIG. 3, the pulley 90 is moved in a direction generally toward the motor pulley 68 and away from the pulley 98. Contrawise, the pulley 90 is moved in a direction generally toward the pulley 98 and away from the pulley 68 corresponding to a counterclockwise rotation of the pulley 68.

Referring now to FIGS. 3, 6, and 7, since the pulley 90 is connected to member 96, movement of the pulley 90 is transferred to pivotal movement of the pivoting arm 92 about the pin 108. As will be seen below, the pivoting arm 92 carries with it, as it pivots, an extendable arm 110 which has one end attached to the work holder 56. Thus, as the arm 92 rotates about the pivot pin 108, so do the arm 110 and the work holder 56. Accordingly, clockwise rotation of the motor pulley 68, as viewed in FIG. 3, results in movement of the work holder 56 toward an edge 100 of the base plate 86, which may be designated as movement in the −X direction, while the work holder is moved toward an opposing edge 102 of the plate 86 corresponding to counterclockwise rotation of the pulley 68, which will be termed the +X direction.

As shown in FIGS. 1–3, one corner of the stepping motor 60 is pivotally mounted on the underside of the base plate 86 by suitable means, such as a bolt 104 extending through an aperture in the plate 86 which is secured in place by a nut beneath the base plate. Two adjacent corners of the motor 60 are slidably mounted on the base plate 86 by similar nut and bolt assemblies, as shown, with bolts 95 and 97 in the respective assemblies being received in slots 95*a* and 97*a*, respectively, extending through the plate 86. The opposing corner of the motor is also slidably mounted on the plate 86 by a nut and bolt assembly, with a bolt 99 in this assembly extending through a slot 99*a* in the plate 86. The ends 101 of a helical spring 103, or other suitable spring means, are connected between a head of the bolt 99 and a bracket assembly 106, which is secured to the upper surface of the base plate 86, as shown. The spring 103 and associated structure is arranged such that the bolt 99 will be positioned adjacent the longitudinal center of the elongated slot 99*a* when the machine is at rest.

During operation of the machine, the stepping motor 60 is permitted to rotate slightly about bolt 104 with the bolts 95, 97 and 99 sliding in their associated slots, while the spring 103 applies forces to the bolt 99 and maintains continuous tension on the cable 76 through the motor pulley 68. The use of the above motor mounting structure for employment of the motor mass in dampening shocks to the cable system is set forth fully in an application Ser. No. 543,099, filed Jan. 22, 1975, and incorporated herein by reference.

As shown in FIGS. 1–3, 6, and 7, one end of the cable 74, which controls radial movement of the extendable arm 110, is secured to a post 112 which depends from the arm 110 adjacent one end thereof remote the work holder 56. From the post 112, the cable 74 is threaded around a free turning pulley 114 which is pivotally mounted to the base plate 86 beneath the arm 110 by suitable means, such as a screw. The cable 74 passes from the pulley 114 to the motor pulley 66 on which the cable is threaded approximately 2¼ turns. From the motor pulley 66, the cable 74 is threaded around a free turning pulley 116, which is pivotally mounted on the base plate 86 by a screw 118, and a free turning pulley 120 which is pivotally mounted on the base plate beneath the arm 110 by suitable means, such as a screw. The other end of the cable 74 passing from the pulley 120 is secured to a post 122 depending from the other end of the arm 110 adjacent the work holder 56.

As best shown in FIG. 3, one corner of the stepping motor 58 is pivotally mounted beneath the base plate 86 by a nut and bolt assembly 123, in a manner similar to that described in connection with the stepping motor 60. As before, adjacent corners of the stepping motor 58 are slidably mounted beneath the base plate 86 by nut and bolt assemblies 124 and 125, while the remote motor corner is slidably mounted below the plate with a nut and bolt assembly 126. A spring 128 has its ends connected to the assembly 126 and a bracket assembly 130 which is secured to the upper surface of the base plate 86. In a manner as previously described, the spring 128 applies forces to the assembly 126, and the cable 74 is thereby maintained under continuous tension through the motor pulley 66.

It will be apparent that as the motor shaft 70 rotates, the cable segment intermediate the pulley 120 and the post 122 will be shortened or enlarged, depending upon the rotational direction of the shaft, while the cable segment intermediate the pulley 114 and the post 112 will be simultaneously enlarged or shortened in an inverse manner. Thus, as viewed in FIG. 3, rotational movement of the motor pulley 66 in a clockwise direction is translated into linear movement of the cable end segments, and results in radial movement of the extendable arm 110 and work holder 56 relative the needle and pivot pin 108 toward an outer edge 132 of the base plate, which may be designated as movement in the +Y direction, while counterclockwise rotation of the motor pulley 66 results in radial movement of the arm 110 and work holder 56 in a direction away from the edge 132, termed the −Y direction. Accordingly, it will be seen that simultaneous energization of the X and Y stepping motors 60 and 58, respectively, causes simultaneous pivotal and radial movement of the work holder in the X and Y coordinate directions, respectively.

Though, at first glance, the coordinate system in which the work holder moves appears to be polar, that is, a coordinate system having a radial component delivered by moving the extendable arm 110 over the pivoting arm 92, and an angular component delivered by rotating the pivoting arm 92 about pivot pin 108, there is built into the system means for causing the work holder to move in what closely approximates a rectangular coordinate system with respect to the needle 54. This means includes apparatus whereby, when the work holder is rotated about pivot pin 108, the circular line of stitching which would normally result from such movement is modified to approximate a straight line of stitching such as would be created in a rectangular coordinate system. This approximation of a straight line of stitching is accomplished automatically by shortening the effective length of the extendable arm 110 by amounts dependent on the amount of rotational movement imparted to the work holder by the pivoting arm 92. The amount by which the effective length of the extendable arm is shortened for a particular angular position of arm 92 is determined by (1) the distance from the post 122 to both the needle 54 and the pivot pin 108, (2) the distance from the axis about which pulley 120 rotates to the post 122 and (3) the radius of the pulley 120 at the inside of its circumferential groove. The pulley 120 is spaced to one side of a line between the pivot pin 108 and needle 54, a distance equal to the radius of the pulley plus one-half the thickness of the cable.

With the structure shown in the drawings, the post 122, for a fixed position of the stepping motor 58 traces a path called the involute of a circle (the circle being the inner circumference of pulley 120), and the result is to pull the post 122 radially inward more and more as the angle through which the arm 92 is rotated increases from its center position. As already discussed,. the amount of radially inward movement required is such as to have the needle sew along a path which approximates a straight line when only a rotational movement is imparted to the work holder by the cable 76. As pivoting arm 92 pivots about pin 108 from its center position, the cable 74 winds or unwinds about the pulley 120, for clockwise or counterclockwise rotation, respectively. As a result, for the same angular rotation of arm 92 from the center position, the compensatory effect will vary depending upon the direction of rotation from the center position. In order to maintain the compensation as symmetrical as possible, it is desirable to keep the radius of the pulley 120 as small as possible, consistent with proper handling of the cable 74.

As described in said co-pending applications, each of the stepping motors 58 and 60 has an associated homing assembly and limit assembly generally designated 133 and 135, respectively. Briefly, the homing assemblies for the stepping motors are utilized to position the work holder during a homing mode at a predetermined home location in the X and Y coordinate directions. The control system automatically enters the homing mode at the beginning and at the end of a sewing operation, during which the work holder is moved to the home position. The home location may be preselected relative the needle by suitable adjustment of the X and Y homing assemblies, and would normally be chosen at a position to permit full range of movement by the work holder in a stitch pattern, as permitted by the limit assemblies. The stepping motors are utilized in an open loop condition during a sewing operation, and the housing assemblies prevent cumulative errors in reference position between consecutive sewing operations by starting each sewing operation at the same home position. Since the work holder and retained work piece are positioned with extreme accuracy at the beginning and end of a sewing operation, auxiliary devices, such as slitting knives to cut buttonholes, may be utilized in conjunction with the machine even when a high degree of positional accuracy is required.

The limit assemblies are utilized to confine movement of the work holder within a predetermined range of positions, and thus limit movement of the work holder relative the needle in the X and Y coordinate directions. In this manner, obstruction between a clamp in the work holder and the sewing needle is prevented, which otherwise might result in damage to the machine and possible injury to the machine operator. The limit assemblies may be adjusted to vary the freedom of movement by the work holder relative the needle.

Figure 8:
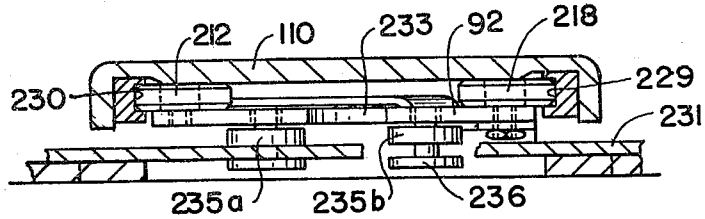
FIG. 8 is a sectional view taken substantially as indicated along the line 8—8 of FIG. 6.

Referring now to FIGS. 6–8, the pivoting arm 92 has a pair of free turning rollers 210 and 212 mounted on the pivoting arm 92 by means of screws 214, and a pair of free turning rollers 216 and 218 attached to levers 220 and 222, respectively, by means of screws 224. The levers 220 and 222 are both attached to the pivoting arm 92 by a screw 226 about which they can freely pivot. A helical spring 228 extends between ends of the levers 220 and 222, with ends of the spring 228 passing through suitable openings in the levers. The spring 228 biases the levers 220 and 222 about the screw 226 and the associated rollers 216 and 218 against a longitudinal track 229, extending along one side of the extendable arm 110, in which the rollers 216 and 218 ride. The rollers 210 and 212 ride in a track 230 which extends longitudinally along the other side of the extendable arm 110. Accordingly, the rollers are spring loaded against the tracks to retain the arms 92 and 110 together, and the rollers move along the respective tracks, with the extendable arm 110 riding on the rollers and moving longitudinally relative the pivotal arm 92. When the extendable arm 110 reaches its furthest radial positions in the +Y and −Y directions, the posts 112 and 122 are received in the cutouts 232 and 233, respectively, formed in the pivoting arm 92 to prevent obstruction between the posts and the arm 92.

As shown, a retaining plate 231 is mounted above the base plate 86, and defines a retaining edge 234 facing toward the pivot pin 108. The pivoting arm 92 has a pair of retaining members 235*a* and 235*b* depending from a forward portion of the arm 92 at a location with a portion of the plate 231 adjacent the edge 234 received in grooves 236 defined in the retaining members 235*a* and *b*. The members 235*a* and *b* move along the edge 234 when the arm 92 is pivoted about the pin 108, and retain the forward portions of the arms 92 and 110 at the desired vertical position relative the base plate 86. In particular, the retaining members 235*a* and *b* prevent the arms 92 and 110 from rising relative the base plate 86 when clamp forces are applied against the work surface of the sewing machine in the region of the needle.

Assembled, the forward part of extendable arm 110, the part nearest the work holder, rides on rollers 212 and 218 while the trailing part of the arm 110 rides on rollers 210 and 216. The work holder, attached to the extendable arm 110, pivots with pivoting arm 92 around pivot pin 108 by means of an opening 217 in pivoting arm 92 through which pin 108 extends. As previously described, pivotal movement is controlled by the cable 76, driven by stepping motor 60. The extendable arm 110 riding on the rollers 210, 212, 216, and 218 in tracks 229 and 230 moves along the pivoting arm 92 in a substantially radial direction with respect to pivot pin 108. The cable 74, driven by stepping motor 58, controls the radial movement of the extendable arm 110. Thus, depending on the direction of motor rotation, one end of the cable at the post 112 pulls while the other end of the cable at the post 122 relaxes, or vice versa. In this way, there is always a positive drive to control radial movement of the extendable arm.

Referring now to FIGS. 1–3, 7 and 9, the work holder 56 has a lower clamp member 238 which is positioned adjacent a work surface 242 of the sewing machine, with the lower clamp member 238 having a rectangular peripheral portion 239 defining a window 241 through which the fabric is sewn. As illustrated in FIGS. 1, 3, and 7, the lower clamp member 238 is secured to a forward end 245 of the extendable arm 110 by a pair of screws 247, such that the lower surface of the clamp member 238 is located adjacent the work surface 242.

As illustrated in FIGS. 1–3, 9, 10, and 11, the work holder also has a fabric clamp member 240 which is brought into position against the upper surface of the lower clamp member 238 to retain the fabric between the two clamp members 238 and 240 during sewing. As shown, the fabric clamp member 240 has a rectangular retaining member 243 defining an opening or window 244 through which the fabric is sewn, with side portions of the retaining member 243 being spaced apart a distance approximately equal to the distance between the sides of the lower clamp member 238, such that the retaining member 243 may engage against the side peripheral portions of the lower clamp member 238 when the fabric clamp member 240 is brought into position against the lower clamp member 238. As will be seen below, the size of the window 244 is preferably selected approximately equal to the size of a label to be sewn onto the fabric.

Figure 9:
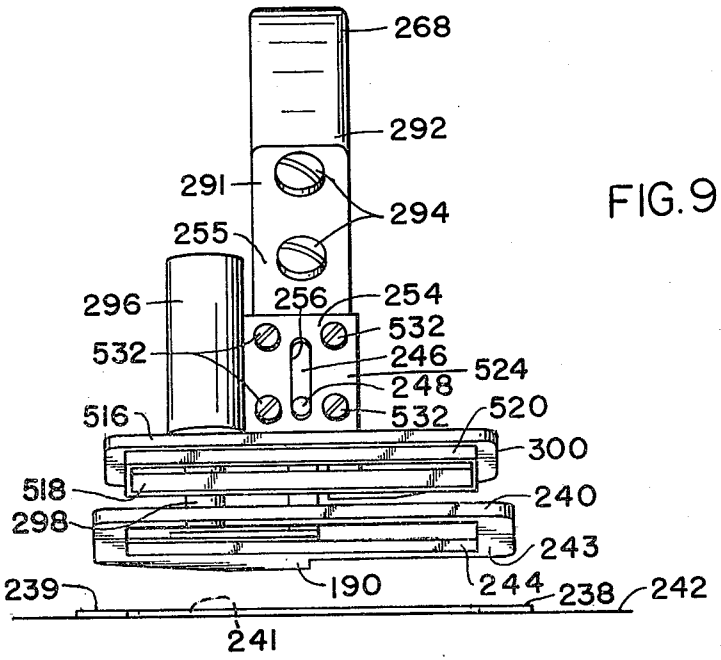
FIG. 9 is a front elevational view of the clamping apparatus of the present invention showing first clamp means of the apparatus spaced from a work surface on the machine and second clamp means of the apparatus spaced from the first clamp means.
Figure 11:
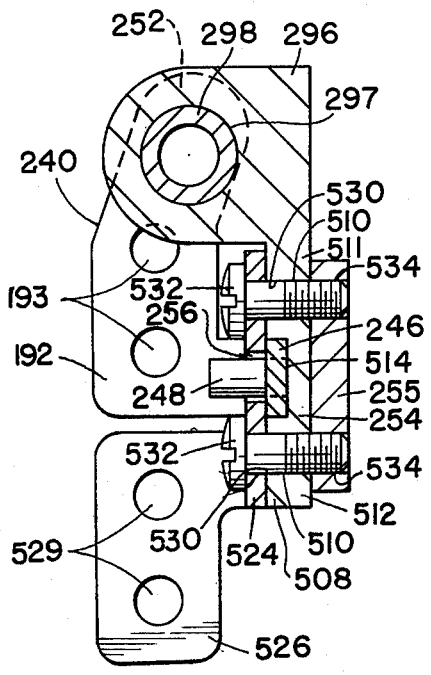
FIG. 11 is a sectional view of assembled portions of the first and second clamp means and air cylinder means.

The clamp member 240 is also has a plate 190 extending rearwardly from the retaining member 243, and a tongue 246 extending upwardly from a base plate 192, with the base plate 192 being secured to the rear plate 190 by a pair of screws 191 extending through apertures 193 in the base plate 192. The tongue 246 has a pin 248 projecting forwardly from a front surface 250 of the tongue 246. As shown, the base plate 192 defines a ledge 252 extending from one side of the tongue 246 adjacent its lower end for a purpose described below. As best shown in FIGS. 2, 9, and 11, the lower clamp member 240 is mounted in a clamp frame 254 with the tongue 246 slidably received in the frame 254. As shown, and as will be further described below, the pin 248 projects through a slot 256 in the frame, and the tongue is permitted to move in the frame between a first lower position with the pin 248 located at a lower end of the slot 256, and a second upper position with the pin 248 located near an upper end of the slot 256.

As illustrated in FIGS. 1 and 3, the clamping apparatus includes a forked retaining member 258 having a pair of lower tines 260 and an ear 262 extending from the lower end of each tine 260. The retaining member 258 is secured to the upper surface of the extendable arm 110 by a pair of screws 264 extending through slots 266 in the ears 262, such that adjustment of the retaining member 258 relative the longitudinal direction of the arm 110 can be made through movement of the screws 264 in the slots 266 prior to securement of the retaining member 258.

An arched locking member 268 has its rearward end 270 pivotally mounted between the tines 260 adjacent a lower end of the forked member 258 by suitable means, such as a pin 272 extending through the tines 260 and locking member 268, as shown. An air cylinder 274 is also provided for actuating the locking member 268 and clamping device. A rearward end 276 of the cylinder 274 is pivotally mounted between a pair of spaced ears 278 extending from an upper end of the retaining member 258 by suitable means, such as a bolt 280 extending through the ears 278 and the rearward end 276 of the cylinder. The locking member 268 has a bracket 282 extending upwardly from a central portion of the member 268, and the forward threaded end 284 of a plunger 286, which is received in the cylinder 274, extends through an aperture 288 in the bracket 282 where it is secured in place by suitable means, such as a nut 290. As shown, an upper end 291 of a clamp bar 255 is secured to a forward end 292 of the locking member 268 by a pair of screws 294.

Figure 12:
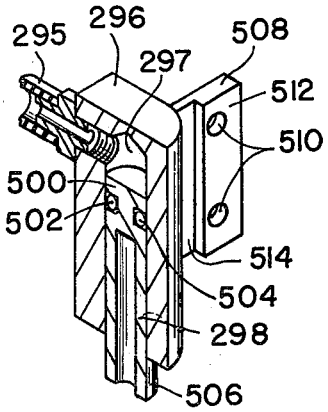
FIG. 12 is a perspective view taken partly in section showing the air cylinder means.

As shown in FIGS. 1–3, and 9–12, a source of air is supplied through a conduit 295 to an air cylinder 296 which is secured to the clamp frame 254. The conduit 295 communicates with an elongated chamber 297 in the cylinder 296, and a piston 298 is slidably received in the chamber 297 for longitudinal movement therein. The piston 298 has a head 500 adjacent an upper portion of the chamber 297, and an O-ring 502 is received in a groove 504 extending peripherally around the piston head 500 to provide sealing engagement with the inner wall of the chamber 297. The piston also has a lower end 506 which bears on the ledge 252 of the fabric clamp member 240, as will be further described below. As illustrated in FIGS. 11 and 12, the clamping apparatus has a mounting member 508 extending from one side of the air cylinder 296, with the mounting member 508 having a pair of threaded apertures 510 extending through inner and outer end portions 511 and 512 of the mounting member 508, and a vertically disposed groove 514 in the inner face of the mounting member 508 and intermediate the inner and outer end portions 511 and 512.

The clamping apparatus has a label clamp member 300 positioned above the fabric clamp member 240. The label clamp member 300 has a generally rectangular retaining element 516 defining an opening or window 518 through which a label is sewn. The retaining element 516 has a depending flange 520 extending peripherally around the opening 518. When the label clamp member 300 is positioned adjacent the fabric clamp member 240, the flange 520 is received in the opening 244 of the lower fabric clamp member 240, with the flange 520 closely spaced from the retaining member 243 of the fabric clamp member 240.

Figure 10:
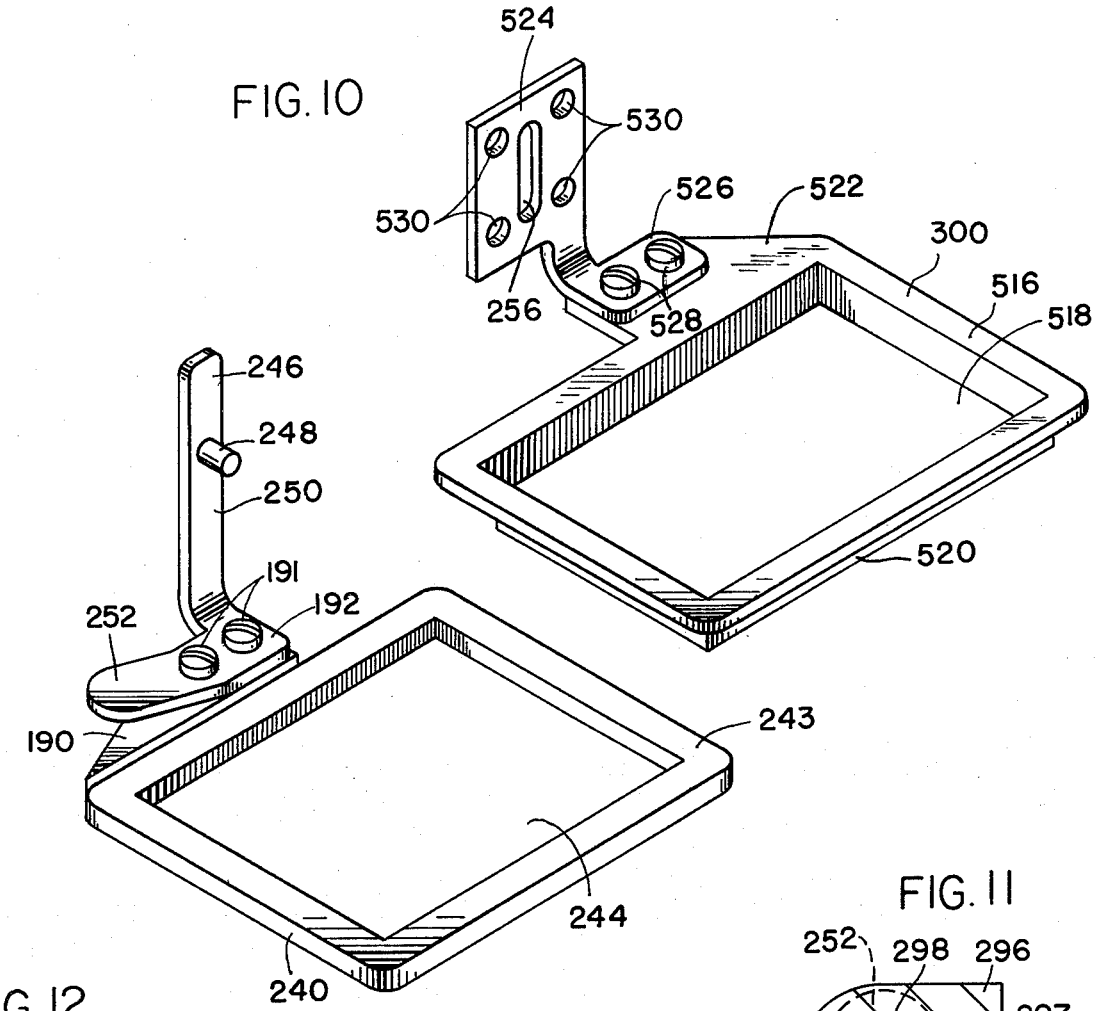
FIG. 10 is an exploded perspective view of the first and second clamp means.

As best shown in FIGS. 10 and 11, the retaining element 516 has a plate 522 extending from its rearward portion. The label clamp member 300 also has a securement flange 524 extending upwardly from the retaining element 516, with a base plate 526 of the securement flange 524 being secured to the plate 522 by suitable means, such as a pair of screws 528 extending through apertures 529 in the plate 526. As shown, the securement flange 524 has a plurality of apertures 530 and the slot 256, as previously described, extending through the flange.

Referring to FIG. 11, the tongue 246 of the fabric clamp member 240 is positioned in the groove 514 of the mounting member 508. The securement flange 524 is positioned against the front face of the mounting member 508. with the tongue pin 248 extending through the slot 256 of the securement flange 524. The assembly is secured together by a plurality of screws 532 which extend through the apertures 530 of the securement flange 524, the aligned apertures 510 in the mounting member 508, and into aligned threaded apertures 534 in the lower end of the clamp bar 255 which has its other end secured to the locking member 268, as previously discussed. As assembled, the tongue 246 of the fabric clamp member 240 is permitted to slide in the groove 514 while the tongue pin 248 moves between the upper portion and the lower end of the slot 256. Additionally, the lower end 506 of the piston 298 is located over the ledge 252 of the fabric clamp member 240.

Referring to FIG. 1–3, prior to a sewing operation, the pressure is reduced in the cylinder 274, and the plunger 286 is thereby retracted into the cylinder. In this configuration, the locking member 268 has been pivoted about the pin 272 to place the member 268 and associated clamp frame 254 in a raised position, as shown in FIG. 9, with the fabric clamp member 240 being spaced from the lower clamp member 238 even though the clamp member 240 is located in its lower first position, as further described below.

As shown in FIGS. 1–3, and 9, when the source of air is supplied to the air cylinder 296, the pressurized cylinder 296 urges the piston 298 against the ledge 252, and the clamp member 240 is driven to its lower first position with the pin 248 on the tongue 246 engaging against the lower part of the slot 256 which serves as a stop. In this configuration, the fabric clamp member 240 is spaced from the upper label clamp member 300 a distance approximately equal to the length of the slot 256, and the fabric clamp member 240 is also spaced above the lower clamp member 238, as shown.

When it is desired to perform a sewing operation, the operator may place the fabric on the lower clamp member 238 with the portion of the fabric to be sewn positioned over the window 241 of the lower clamp member 238. Next, the operator depresses a first foot pedal of known type, and the control system in response generates a signal which results in the supply of a moderate amount of air pressure from an air source to the air cylinder 274. In turn, the plunger 286 is partially driven from the cylinder 274, thus lowering the locking member 268 and the fabric clamp member 240 to a position against the fabric to be sewn and lower clamp member 238, such that the fabric is retained between the clamps 238 and 240 at this time. However, the forces, e.g., 2–3 lbs., applied to the clamp frame 254 by the cylinder 274 through the locking member 268 are less than the forces, e.g., 3–3.8 lbs., applied to the clamp member 240 by the air cylinder 296 through the piston 298 and ledge 252. Accordingly, the fabric clamp member 240, although engaged against the fabric, remains in its lower first position with the pin 248 located at the lower end of the slot 256, and with the fabric clamp member 240 spaced from the upper label clamp member 300.

Next, the operator may insert the label to be sewn into the opening 244 of the clamp member 240, such that the label overlies the fabric. The opening 244 serves as a guide for placement of the label, since preferably their sizes are approximately the same. After placement of the label, the operator fully depresses the first foot pedal to a second position and, in response, the control system generates a signal which causes full pressure to be developed in the cylinder 274 from the air source. While in this condition, the forces, e.g., 10 lbs., applied by the cylinder plunger 286 through the locking member 268 to the clamp frame 254 are greater than those applied by the air cylinder 296 between the frame 254 and clamp member 240. Accordingly, the clamp frame 254 is driven toward the machine work surface 242 along with the associated upper clamp member 300, while the ledge 252 of the fabric clamp member 240 bears against the piston 298 and drives the piston 298 back into the cylinder 296.

When the locking member 268 and clamp frame 254 are fully lowered, the retaining element 516 of the label clamp member 300 is located adjacent the fabric clamp member 240, and the flange 520 engages and retains the label in place above the fabric between the flange 520 and lower clamp member 238. In this configuration, it will be apparent that the fabric clamp member 240 has been placed in its second upper position, with the pin 248 of the clamp tongue 246 located near the upper end of the slot 256, and with the piston 298 being fully depressed into the cylinder 296 by the clamp ledge 252.

At this time the fabric and label are retained in a proper position for initiation of a sewing operation, and the operator may then depress a second pedal to initiate the run. When the second pedal is depressed, the machine automatically enters the homing mode followed by the sewing operation during which the label is sewn to the fabric by the needle through the openings or windows of the various clamp members of the work holder. After the sewing operation has been completed, the machine enters another homing mode, and the fabric and label clamp members 240 and 300 are automatically raised to the configuration shown in FIG. 9 by reducing the air pressure in the cylinder 274. The sewn fabric and label may then be removed from the work holder by the machine operator.

The foregoing detailed description is given for clearness of understanding only, and no unnecessary limitations should be understood therefrom, as modifications will be obvious to those skilled in the art.

What is claimed is:

1. Clamping apparatus for an automatic sewing machine having a sewing needle, comprising:

frame means;

first clamp means being movable with said frame means toward and away from a work surface of the machine for retaining a first work piece;

second clamp means secured at a fixed position on said frame means for retaining a second work piece adjacent the first work piece;

means for movably mounting the first clamp means for relative movement toward and away from the second clamp means, with the first clamp means being located intermediate the second clamp means and the work surface;

first means for applying a separating force against said first clamp means to separate said first and second clamp means;

second means for selectively applying a variable force against the frame means in a direction urging the second clamp means toward the first clamp means, the second applying means separately applying a force of a first level less than said separating force during a first mode of operation and a force of a second level greater than said first level and said separating force during a second mode of operation, the second applying means moving the first clamp means toward the work surface with the first and second clamp means being located in a first separated relative position during said first mode of operation, and the second applying means overcoming the separating force of the first applying means during the second mode of operation to move the second clamp means toward the first clamp means from said first position to a second relative clamping position for retaining the first and second work pieces together; and means for moving said frame means and clamp means relative said needle to perform a sewing operation on said work pieces during said second mode of operation.

2. The apparatus of claim 1 including third clamp means located adjacent said work surface, said first clamp means being movable toward and away from the third clamp means.

3. The apparatus of claim 2 wherein the third clamp means includes opening means for performing a sewing operation through the opening means.

4. The apparatus of claim 1 including extendable arm means, means for pivotally mounting the arm means to the machine, and means for mounting the third clamp means to the arm means adjacent an end remote the pivotally mounting means.

5. The apparatus of claim 1 wherein the first and second clamp means each include opening means which are generally aligned when the clamp means are located in said second position.

6. The apparatus of claim 5 in which the first clamp means includes a retaining member defining said opening means, and in which said second clamp means comprises a retaining element defining said opening means, said retaining element having depending flange means receivable in the opening means of the first clamp means in said second position.

7. The apparatus of claim 5 in which said flange means extends peripherally around the opening means of the retaining element and is located adjacent sides of the retaining member defining its opening means in said second position.

8. The apparatus of claim 6 including third clamp means located adjacent said work surface, with said first clamp means being movable toward and away from the third clamp means, and in which the retaining element engages against the fabric to be sewn and said third clamp means.

9. The apparatus of claim 1 wherein the first applying means comprises cylinder means urging the first and second clamp means away from each other toward said first position.

10. The apparatus of claim 9 wherein said cylinder means is connected to the second clamp means, said cylinder means having a piston bearing against the first clamp means for moving the first clamp means apart from the second clamp means.

11. The apparatus of claim 1 including stop means for limiting movement of the first and second clamp means at said first position.

12. The apparatus of claim 11 wherein the stop means comprises, frame means connected to the second clamp means, tongue means extending generally upwardly from the first clamp means and being slidably received in the frame means, and interengaging stop members on the tongue means and frame means to limit movement of the tongue means in the frame means.

13. The apparatus of claim 12 wherein the stop members comprise, elongated slot means in the frame means being generally aligned with the tongue means, and pin means extending from the tongue means and being received in said slot means, said pin means engaging against the lower end of the slot means to limit movement of the pin means in the slot means and the connected tongue means in the frame means.

14. The apparatus of claim 1 wherein the second applying means includes means for selectively removing the applied force from the second clamp means and raising the clamping apparatus relative the work surface.

15. The apparatus of claim 1 wherein the second applying means comprises, said frame means connected to the second clamp means, and means for driving the frame means at variable force levels.

16. The apparatus of claim 15 wherein the frame means comprises an arched locking member having one end connected to the second clamp means, and means for pivotally mounting the other end of the locking member, and in which the second applying means includes piston means connected to a central portion of the locking member for driving the locking member about said pivotally mounting means.

17. The apparatus of claim 16 including extendable arm means, and means for pivotally mounting the arm means to the machine, and in which the locking member mounting means pivotally connects the locking member to the arm means for pivotal and radial movement of the locking member and clamping apparatus relative the arm means mounting means.

18. The apparatus of claim 1 wherein the first clamp means has opening means of a size approximately equal to the size of the second work piece.

19. Clamping apparatus for an automatic sewing machine having a sewing needle, comprising:

a lower clamp member having opening means through which a sewing operation is performed, and an upwardly extending tongue;

an upper clamp member having opening means through which the sewing operation is performed;

frame means connected to the upper clamp member at a fixed position relative each other and slidably receiving said tongue for movement of the lower clamp member between a first position with the lower clamp member being spaced below the upper clamp member and a second position with the lower clamp member being positioned adjacent the upper clamp member;

means for limiting movement of the lower clamp member at said first position;

piston means connected to the frame means for applying a separating force against the lower clamp member and moving the lower clamp member to said first position;

means for sequentially applying separate first and second forces against the frame means in a direction generally toward a work surface of the machine, said first force being at a level less than said separating force, and said second force being at a level greater than said first and separating forces; and means for moving said frame means and clamp members relative said needle to perform a sewing operation.

20. The apparatus of claim 19 wherein the applying means includes means for removing said first and second forces from the frame means and raising the clamping apparatus.

21. The apparatus of claim 19 wherein said lower clamp member includes ledge means, and said piston means includes a plunger bearing against said ledge means.

22. The apparatus of claim 19 wherein the limiting means comprises, an elongated upright slot in the frame means, and a pin extending outwardly from said tongue and received in said slot, said pin engaging against the lower end of said slot at said first position to limit movement of the tongue in said frame means.

23. A label sewing attachment for an automatic sewing machine having a work supporting means and stitch forming mechanism means, said attachment comprising:

an arched locking means pivotally secured to said automatic sewing machine;

a frame assembly means carried by said arched locking means;

a pneumatically actuated upper label clamp assembly means secured to said frame assembly means for clamping a label;

a pneumatically actuated lower fabric clamp assembly means secured to said frame assembly means for clamping a label;

a pneumatically actuated lower fabric clamp assembly means slidably mounted to said frame assembly means and movable into and out of clamping engagement with said upper label clamping assembly for clamping a work piece;

a first pneumatic means controlling the raising and lowering of said arched locking means with respect to said work supporting means, and forceably driving said upper clamp label assembly means through said frame assembly means into a cooperating clamping relationship with said lower fabric clamp assembly means holding a label to be attached to a work piece by said stitch forming mechanism means; and means for moving said locking means and clamp assembly means relative the stitch forming mechanism means to perform a sewing operation on the retained label and work piece.

24. The label sewing attachment of claim 23 including, a second pneumatic means forceably moving said lower fabric clamping assembly between first and second positions.

25. The label sewing attachment of claim 23 wherein said pneumatically actuated lower fabric clamp means has a label receiving aperture means for positioning a label and clamping said work piece means, and said second pneumatically actuated upper label clamp assembly means has a portion thereof intermittently disposed within said label receiving aperture means for clamping a label to the work piece.

26. An article attaching machine comprising:

a work supporting surface means;

a stitch forming mechanism means;

an arched locking means fulcrumed at first end means on said machine;

a fabric supporting means overlying said work supporting surface means;

a fabric clamp means overlying said fabric supporting means having an article receiving aperture means;

an article clamp means overlying said fabric clamp means;

a common support means for both clamp means and means operatively securing said common support means to said arched locking means;

said fabric clamp means having a vertical slidable relationship relative said common support means;

a first air cylinder means being movable between an initial position to first and second positions in separate first and second stages, said first air cylinder indirectly acting upon said common support means;

a second air cylinder means individually acting upon said fabric clamp means and constantly urging it towards said work supporting surface means;

said first air cylinder means acting during its first stage of movement to depress said label clamp means and said fabric clamp means towards said work supporting means for clamping a work piece placed on said fabric supporting means;

said second air cylinder means providing an opposing force maintaining a spaced relationship between said label clamp means and said fabric clamp means whereby exposing said article receiving aperture means; and said first air cylinder means operative during its second state of movement to forceably depress said upper label clamp means into contact with an article positioned in said article receiving aperture means whereby clamping said article.

27. The article attaching machine of claim 26 including foot pedal means having first and second position switches therein for controlling the movement between said first and second positions of said first air cylinder means.

28. The article attaching machine of claim 26 wherein said first air cylinder means includes means for holding the arched locking means in a raised position.

29. The article attaching machine of claim 26 wherein said second air cylinder means is operatively secured to said common support means.

30. The article attaching means of claim 26 wherein said common support means includes means for defining the amount of vertical reciprocation of said lower fabric clamp means.

* * * * *